United States Patent [19]

Graham

[11] Patent Number: 4,481,688

[45] Date of Patent: Nov. 13, 1984

[54] CLEANING SPONGE CONNECTION FOR A WRINGER-TYPE MOP

[75] Inventor: John W. Graham, Simpsonville, S.C.

[73] Assignee: Chambertin Corporation, Simpsonville, S.C.

[21] Appl. No.: 543,438

[22] Filed: Oct. 19, 1983

[51] Int. Cl.[3] ..... A47L 13/144

[52] U.S. Cl. ..... 15/119 A

[58] Field of Search ..... 15/116 A, 119 A, 116 R, 15/119 R

[56] References Cited

U.S. PATENT DOCUMENTS 3,727,259 4/1973 Wilson ..... 15/119 A 4,196,488 4/1980 Barry ..... 15/119 A

*Primary Examiner*—Edward L. Roberts

*Attorney, Agent, or Firm*—Bell, Seltzer, Park & Gibson

[57] ABSTRACT

The cleaning sponge connection of the present invention may be easily and quickly connected and disconnected with the lower end of the usual operating rod by simply changing the angular position of the cleaning sponge and slipping the free end of the latch hook into and out of a latch tunnel formed on the cleaning sponge support channel. The present connection requires that the cleaning sponge operating mechanism position the cleaning sponge in only two positions, that is, the wringing and cleaning positions and requires no extraneous connecting devices such as bolts and nuts or latching plates and the like.

4 Claims, 5 Drawing Figures

11
10
17
18
16
20
12a
12
12c
15
13
14
24

30
22
31

33
32
21
12b

26

CLEANING SPONGE CONNECTION FOR A WRINGER-TYPE MOP

FIELD OF THE INVENTION

This invention relates generally to a cleaning sponge connection for a wringer-type mop and more particularly to such a connection which may be quickly and easily operated to disconnect and connect the cleaning sponge for removal and replacement thereof.

BACKGROUND OF THE INVENTION

Wringer mops having replaceable cleaning sponges have been known for some time and usually require the removal and replacement of a threaded bolt and nut to remove and replace the cleaning sponge. The removal and replacement of the threaded bolt and nut usually requires the use of hand tools which are not readily available to the housewife and which are not easily operable in the confined space in which they are usually positioned. Also, the nut and screw arrangement may become rusted and corroded with use and is difficult to remove and replace.

U.S. Pat. No. 3,727,259 discloses a cleaning sponge connection for a wringer mop which eliminates the need for a nut and bolt connection. The nut and bolt connection is replaced by a hook arm and a biased snap-latch which is operable to permit the cleaning sponge to be removed from the hook arm and replaced by a new cleaning sponge. However, the use of this type of connection requires that the cleaning head operating mechanism be operable to move the cleaning sponge to three different positions, that is, an innermost position where the cleaning sponge is drawn between the squeezing rollers for squeezing liquid from the cleaning sponge, a first outer or intermediate position with the lower portion of the cleaning sponge extending outwardly between the squeezing rollers to a cleaning position, and a second outer position with the cleaning sponge and the support channel positioned outwardly beyond the squeezing rollers to a position where the cleaning sponge may be removed from the hook arm. Also, the production of the biased snap-latch increases the cost of the manufacture of the wringer mop and the snap-latch arrangement may be bent or become corroded so that it is inoperative.

SUMMARY OF THE INVENTION

With the foregoing in mind, it is an object of the present invention to provide a cleaning sponge connection for a wringer-type mop which is simple and economical to produce and which may be quickly and easily operated to replace the cleaning sponge with the operating mechanism in the normal cleaning position.

In accordance with the present invention, the cleaning sponge connection includes a latch hook formed integral with the lower end of the usual cleaning sponge operating rod and having a medial portion extending parallel to the wringing rollers. A latch tunnel is turned upwardly from the upper wall of the cleaning sponge support channel and includes upwardly curved end portions at opposite ends thereof. Depressions are formed in the upper wall of the channel and at opposite ends of the latch tunnel to normally maintain the medial portion of the latch hook in the latch tunnel. The cleaning sponge is removable from the latch hook by simply moving the end of the support channel and cleaning sponge corresponding with the free end of the latch hook inwardly between the rollers so that the support channel assumes an acute angular position relative to the latch hook. Only a small amount of inward movement of the end of the support channel is required, about one-half inch, to impart a sufficient angular position, about five degrees, to the support channel so that the latch hook can be removed from the latch tunnel. The latch hook may then be longitudinally moved out of the latch tunnel since the corresponding depression will be positioned beneath the level of the latch hook.

A new cleaning sponge may be easily connected to the latch hook by moving the same into position between the wringing rollers, moving the end of the support channel corresponding with the free end of the latch hook inwardly between the wringing rollers so that the channel assumes an acute angular position relative to the latch hook and the latch hook can then be moved into position in the latch tunnel. The end of the cleaning sponge is then moved outwardly to the normal position between the wringing rollers with the support channel parallel with the wringing rollers so that the depressions at opposite ends of the latch tunnel limit longitudinal movement and removal of the latch hook therefrom.

The present cleaning sponge connection eliminates the need for the use of bolts and nuts and also the need for any extraneous latching mechanism of the type heretofore used in removably connecting a cleaning sponge to a wringer mop. Openings are provided along opposite sides of the cleaning head support housing to provide access for the finger to move the latch hook into and out of latched position.

BRIEF DESCRIPTION OF THE DRAWINGS

Other objects and advantages will appear as the description proceeds when taken in connection with the accompanying drawings, in which.

DESCRIPTION OF THE ILLUSTRATED EMBODIMENT

Figures 1, 2, 3, 4, 5:
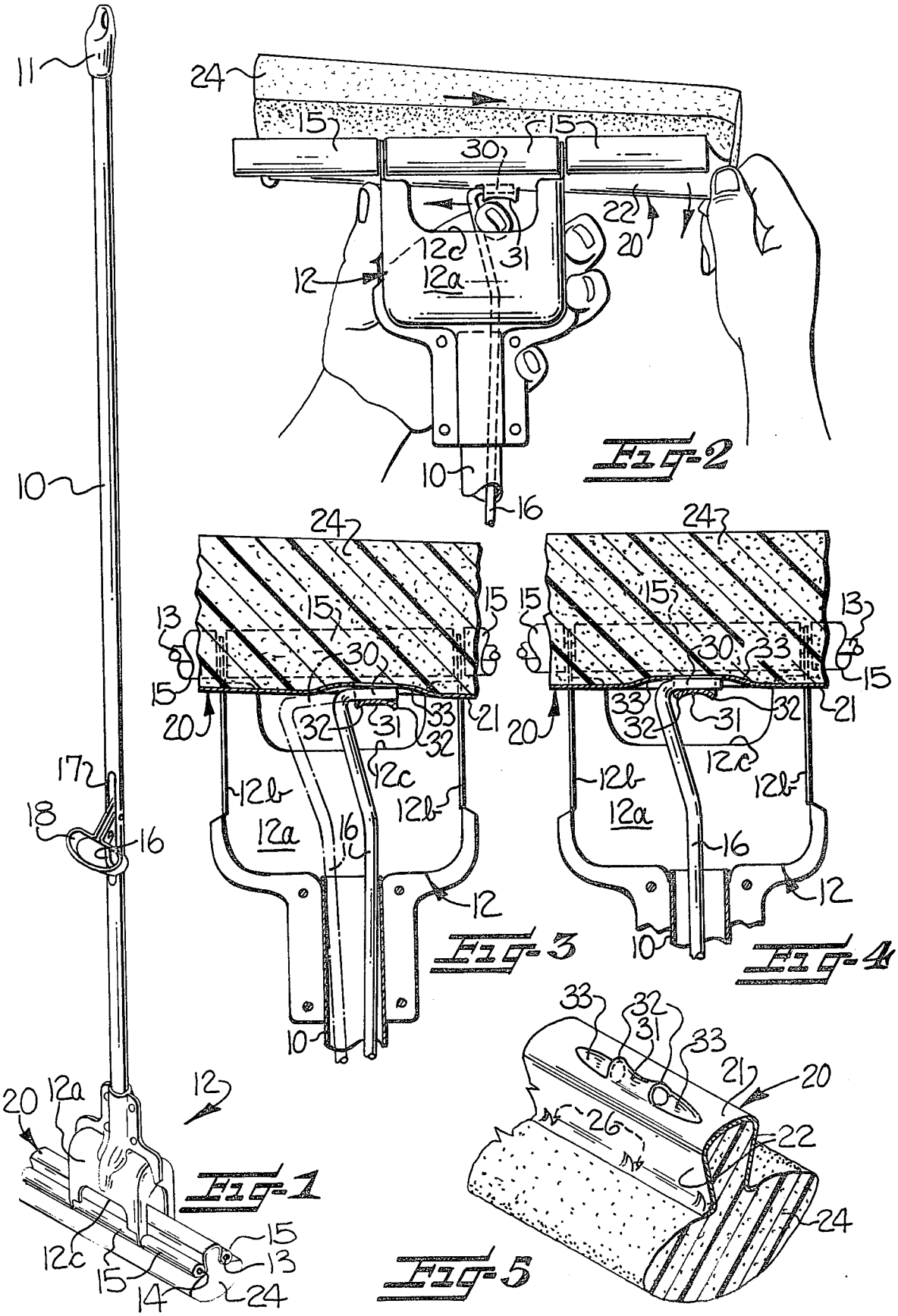
FIG. 1 is a perspective view of a wringer-type mop with the cleaning sponge connection of the present invention associated therewith.
FIG. 2 is an elevational view of the lower end of the mop shown in FIG. 1 and illustrating the manner in which one end of the cleaning sponge is moved inwardly between the wringing rollers in preparation for removal thereof.
FIG. 3 is a fragmentary longitudinally extending vertical sectional view through the central portion of FIG. 2 and illustrating the manner in which the latch hook is moved to the unlatched position, as shown in dash-dot lines, for removal and replacement of the cleaning sponge.
FIG. 4 is a view similar to FIG. 3 but showing the latch hook in position after the cleaning sponge has been replaced.
FIG. 5 is a fragmentary isometric view of the central portion of the cleaning sponge and illustrating the manner in which the latch tunnel and depressions are formed in the upper wall of the support channel.

The wringer mop generally includes an elongate handle, in the form of a hollow tube 10, with a suitable closure element 11 fixed at one end and which may include an opening for facilitating hanging the mop on a nail, pin or the like. A cleaning head support housing, broadly indicated at 12, is fixed on the other end of the handle 10 and may be formed in two halves of stamped sheet metal. The housing 12 has the general shape of a hollow bell having generally flat front and rear side walls 12*a* and end walls 12*b*. The side walls 12*a* are provided with elongate slots 12*c* to provide access for the finger when removing and replacing the cleaning head, in a manner to be presently described. The end walls 12*b* are bifurcated to provide support legs for a pair of roller support shafts 13, 14 (FIG. 1) on which first and second sets of spaced-apart wringer rollers 15 are supported. The spaced-apart sets of rollers 15 define an elongate passageway therebetween.

An operating rod 16 extends upwardly through the handle 10 and has an upper end terminating along a medial portion of the handle and bent outwardly at an angle through a slot 17 therein. An operating lever 18 is pivotally connected at its inner end to the handle 10 and the upper end of the operating rod 16 is pivotally connected to a medial portion of the operating lever 18. The operating lever 18 is operable to impart longitudinal inward and outward movement to the operating rod 16.

A sheet metal support channel, broadly indicated at 20, is provided with an upper wall 21 and downwardly extending side walls 22 which are normally positioned between the sets of squeeze rollers 15. The upper portion of a cleaning sponge 24 is fixed in the channel 20 and held between the side walls 22 by inwardly bent gripping fingers 26 (FIG. 5). When in the normal cleaning position, the lower portion of the cleaning sponge 24 extends outwardly beyond the spaced-apart sets of rollers 15 while the side walls 22 of the channel 20 are positioned between the rollers 15, as illustrated in FIG. 1.

A latch hook 30 is integrally formed at one end of the operating rod 16 and has a medial portion extending parallel to the rollers 15 and the upper wall 21 of the support channel 20. The inner end of the latch hook 30, which is integral with the operating rod 16, is formed by bending the operating rod 16 at an acute angle and then at slightly greater than a right angle so that the latch hook 30 extends perpendicular to the operating rod 16. The free end and the medial portion of the latch hook 30 thus form a part of the connecting means for selectively connecting and disconnecting the lower end of the operating rod 16 with the channel 20 for removal and replacement of the cleaning sponge 20, when necessary.

The connecting means also includes a latch tunnel 31 turned upwardly from the upper wall 21 of the channel 20 and including upwardly curved portions 32 (FIG. 5) at opposite ends thereof. Identical depressions 33 are formed in the upper wall 21 of the channel 20 and at opposite ends of the latch tunnel 31. The depressions 33 extend outwardly from opposite ends of the latch tunnel 33 a distance which is substantially one-half the length of the latch hook 30 and are formed in the upper wall 21 to a depth of substantially one-half the diameter of the latch hook 30. The central portion of the latch tunnel 31 extends upwardly above the level of the upper wall 21 of the channel 20 a distance which is substantially one-half the diameter of the latch hook 30 so that the latch hook 30 will pass beneath the latch tunnel 31, in a manner to be presently described, and as shown in FIG. 4.

With the latch hook 30 positioned beneath the latch tunnel 31, as illustrated in FIG. 4, the depressions 33 prevent the longitudinal movement of the latch hook 30 out of the latch tunnel 31 as long as the channel 20 is maintained at right angles to the operating rod 16 and parallel to the rollers 15. With the latch hook 30 thus connected to the channel 20, the mop may be used in the normal manner and the position of the cleaning sponge 24 is controlled by the movement of the operating lever 18. When the operating lever 18 is moved upwardly from the position shown in FIG. 1, the cleaning sponge 24 is drawn inwardly between the wringer rollers 15 so that any liquid in the cleaning sponge 24 is squeezed therefrom. When the operating lever 18 is moved back to the position shown in FIG. 1, the cleaning sponge 24 is moved outwardly between the rollers 15 and to the cleaning position shown in FIG. 1.

In order to remove and replace the cleaning sponge 24, the operating lever 18 is moved to the position shown in FIG. 1 with the channel 20 parallel to the wringing rollers 15. The cleaning sponge 24 may be shifted longitudinally in the direction of the free end of the latch hook 30 and then the end of the channel 20 corresponding with the free end of the latch hook 30 may be moved inwardly between the rollers 15 a distance of about one-half inch, as illustrated in FIG. 2, so that the channel 20 assumes an acute angular position of about four to five degrees relative to the latch hook 30. As illustrated in FIGS. 2 and 3, the finger is then moved into one of the elongated access slots 12*c* so that the latch hook 30 may then be longitudinally moved and easily removed from the latch tunnel 31 since the outer end of the corresponding depression 33 is above the longitudinal movement of the latch hook 30.

To connect a new cleaning sponge 24, the channel 20 is slipped longitudinally between the rollers 15. The end portion is moved inwardly, as illustrated in FIG. 2, so that the channel 20 assumes an acute angular position relative to the latch hook 30. The finger or thumb is then moved into the elongated access slot 12*c* to move the latch hook 30 from the dash-dot line position shown in FIG. 3 to the solid-line position with the medial portion of the latch hook 30 positioned beneath the latch tunnel 31. The end of the new cleaning sponge 24 then is released so that it is in parallel relationship with the rollers 15. The cleaning sponge 24 then is shifted longitudinally so that it is centered between the rollers 15 and the connection of the new cleaning sponge 24 to the operating rod 16 and latch hook 30 is completed, as illustrated in FIG. 4.

The cleaning sponge connection of the present invention thus requires no bolts and nuts or other extraneous connection means but is simply and easily connected to and disconnected from the lower end of the operating rod 16 by simple manipulation of the cleaning sponge 24 and the latch hook 30. Since both ends of the latch tunnel 31 are curved upwardly in the same manner and identical depressions 33 are provided at opposite ends thereof, either end of the cleaning sponge 24 may be inserted between the rollers 15 and easily connected to the latch hook 30.

In the drawings and specification there has been set forth the best mode presently contemplated for the practice of the present invention, and although specific terms are employed, they are used in a generic and descriptive sense only and not for purposes of limitation, the scope of the invention being defined in the claims.

That which is claimed is:

1. In a wringer-type mop including an elongate handle, a cleaning head support housing fixed on one end of said handle and having generally flat front and rear side walls and bifurcated end walls forming support legs, first and second sets of spaced-apart rollers supported on said support legs of said housing and defining an elongate passageway therebetween, an operating rod extending along said handle and having an upper end terminating along a medial portion of said handle, an operating lever operatively connected to the upper end of said operating rod and said handle and being operable to impart longitudinal inward and outward movement to said operating rod, a channel including an upper wall and side walls extending between said spaced-apart sets of rollers, and a cleaning sponge having an upper portion fixed between said side walls of said channel and having a lower portion normally extending outwardly in a cleaning position between said spaced-apart rollers, said operating lever being manually movable to selectively move said cleaning sponge inwardly to squeeze the same between said rollers and to move said cleaning sponge outwardly to cleaning position, the combination therewith of improved connecting means for selectively connecting and disconnecting the lower end of said operating rod with said channel for removal and replacement of said cleaning sponge, said improved connecting means comprising a latch hook having one end integral with said operating rod, a medial portion extending parallel to said rollers, and a free end, a latch tunnel turned upwardly from said upper wall of said channel and including upwardly curved end portions at opposite ends thereof, and depressions formed in said channel and at opposite ends of said latch tunnel, said medial portion of said latch hook extending beneath said latch tunnel with its longitudinal axis parallel with and at the same level as the upper surface of said upper wall of said channel so that longitudinal movement of said medial portion of said latch hook is normally limited by said depressions, said side walls being provided with elongate access slots to permit entry of the finger, said cleaning sponge being removable from said latch hook to replace the same by moving the end of said channel corresponding with the free end of said latch hook inwardly between said rollers so that said channel assumes an acute angular position relative to said latch hook so that said latch hook may be longitudinally moved and easily removed therefrom by a finger inserted through the access slot in one of said side walls.

2. A wringer-type mop according to claim 1 wherein the length of each of said depressions at each end of said latch tunnel is substantially one-half the length of said latch hook.

3. A wringer-type mop according to claim 1 wherein the depth of each of said depressions is substantially one-half the diameter of said latch hook, and wherein said latch tunnel extends upwardly above said upper wall of said channel substantially one-half of the diameter of said latch hook.

4. A wringer-type mop according to claim 1 wherein inward movement of the end of said channel a distance of about one-half inch positions said channel at about a five-degree angle relative to said rollers and permits movement of said latch hook into and out of said latch tunnel.

* * * * *